US009796565B2

(12) United States Patent
Paβmann et al.

(10) Patent No.: US 9,796,565 B2
(45) Date of Patent: Oct. 24, 2017

(54) CRANE, IN PARTICULAR AN OVERHEAD CRANE OR GANTRY CRANE, HAVING AT LEAST ONE CRANE GIRDER

(71) Applicant: Terex MHPS GmbH, Düsseldorf (DE)

(72) Inventors: Christoph Paβmann, Dortmund (DE); Richard Kreisner, Ennepetal (DE); Michael Karden, Wetter (DE); Thomas Schlierbach-Knobloch, Herdecke (DE)

(73) Assignee: Terex MHPS GmbH, Düsseldorf (DE)

( * ) Notice: Subject to any disclaimer, the term of this patent is extended or adjusted under 35 U.S.C. 154(b) by 479 days.

(21) Appl. No.: 14/355,407

(22) PCT Filed: Mar. 28, 2013

(86) PCT No.: PCT/EP2013/056778
§ 371 (c)(1),
(2) Date: Apr. 30, 2014

(87) PCT Pub. No.: WO2013/144319
PCT Pub. Date: Oct. 3, 2013

(65) Prior Publication Data

US 2014/0291269 A1 Oct. 2, 2014

(30) Foreign Application Priority Data

Mar. 30, 2012 (DE) ..... 10 2012 102 809

(51) Int. Cl.
*B66C 17/00* (2006.01)

(52) U.S. Cl.
CPC ..... *B66C 17/00* (2013.01); *Y10T 29/49634* (2015.01)

(58) Field of Classification Search
CPC .... B66C 5/00; B66C 5/02; B66C 5/04; B66C 5/06; B66C 6/00; B66C 7/00; B66C 7/08;
(Continued)

(56) References Cited

U.S. PATENT DOCUMENTS 327,360 A 9/1885 Vanes
2011/0247993 A1 10/2011 Chernyak

FOREIGN PATENT DOCUMENTS

DE 185560 5/1907
DE 189383 9/1907
(Continued)

OTHER PUBLICATIONS

English Translation of International Preliminary Report on Patentability for corresponding PCT Application No. PCT/EP2013/056778, dated May 28, 2013.
(Continued)

*Primary Examiner* — Sang Kim
*Assistant Examiner* — Juan Campos, Jr.
(74) *Attorney, Agent, or Firm* — Gardner, Linn, Burkhart & Flory, LLP

(57) ABSTRACT

A crane, in particular an overhead crane or gantry crane, comprising at least one crane girder, which extends horizontally and is designed as a trussed girder having an upper run and a lower run. A crane trolley having a lifting device can be moved on the crane girder. The invention further relates to a method for assembling a crane girder, comprising an assembly step for producing the trussed structure of the crane girder. The crane girder includes an adapter on at least one of the two opposite ends, which adapter can be fastened to the upper run and the lower run in such a way that the adapter can be oriented relative to the upper run and the lower run and then the adapter can be welded onto the upper run and the lower run in a desired position.

13 Claims, 7 Drawing Sheets

(58) Field of Classification Search
CPC ..... B66C 11/00; B66C 11/14; B66C 17/00–17/26; B66C 19/00; B66C 19/002; B66C 19/005; B66C 19/007; B66C 19/02; Y10T 29/49634; B61B 13/04; B61B 5/02; E01B 25/08; E01B 25/10
USPC ..... 104/118–121
See application file for complete search history.

(56) References Cited

FOREIGN PATENT DOCUMENTS

| | | |
|---|---|---|
| DE | 260030 | 3/1912 |
| DE | 1971793 | 11/1967 |
| DE | 1971794 | 11/1967 |
| DE | 1907455 | 10/1969 |
| DE | 3109834 | 1/1982 |
| DE | 3222307 | 12/1983 |
| DE | 102012102808 | 3/2012 |
| FR | 1391167 | 1/1965 |
| JP | S5360277 | 5/1978 |
| JP | S62259987 | 11/1987 |
| JP | H027284 | 1/1990 |
| JP | H11165980 | 6/1999 |

OTHER PUBLICATIONS

International Search Report for corresponding PCT Application No. PCT/EP2013/056778 dated May 28, 2013.
Written Opinion for corresponding PCT Application No. PCT/EP2013/056778.

CRANE, IN PARTICULAR AN OVERHEAD CRANE OR GANTRY CRANE, HAVING AT LEAST ONE CRANE GIRDER

CROSS REFERENCE TO RELATED APPLICATIONS

The present application claims the priority benefits of International Patent Application No. PCT/EP2013/056778, filed Mar. 28, 2013, and also of German Patent Application No. DE 10 2012 102 809.5, filed Mar. 30, 2012.

FIELD OF THE INVENTION

The invention relates to a crane, in particular an overhead crane or gantry crane, having at least one crane girder that extends horizontally and is designed as a trussed girder having an upper run and a lower run, on which girder a crane trolley having a lifting gear can be moved, and the invention further relates to a method of assembly such a crane girder.

BACKGROUND OF THE INVENTION

It is generally known to provide a crane having at least one crane girder, such as a trussed girder, that extends horizontally and has an upper run and a lower run, with a crane trolley having a lifting gear being movably mounted thereto. However, the conventional production of crane girders involves beginning with components at an excess size, followed by subsequent burning off or shortening the components to the desired finished size or length.

For example, German patent specification DE 260 030 discloses a so-called double-girder gantry crane having two horizontal crane girders and two vertical support girders that form a gantry frame of the gantry crane. The crane girders extend in parallel and at a spaced interval with respect to each other. Arranged at each of the lower ends of the support girders is a travelling mechanism, by means of which the gantry crane can be moved in a direction of travel extending transversely with respect to the longitudinal direction of the crane girders. A crane trolley having a cable winch can be moved on and along the crane girders. According to the design as a double-girder crane, a load picking-up means of the cable winch arranged on the crane trolley is lowered or raised between the two crane girders. The crane girders are formed as a trussed girder and include in each case an upper run and a lower run which are each oriented horizontally and in parallel with each other. The upper and lower runs of the two crane girders are connected to one another by means of vertically extending, rod-shaped posts and diagonally extending, rod-shaped struts. The two crane girders are connected to one another at their ends by means of transverse rods and struts to form a frame. Rod-shaped posts and struts are provided along the longitudinal direction of the crane girders between the upper and lower run as a type of truss and each connect an upper run to the lower run arranged vertically therebelow.

German utility model document DE 1 971 794 U describes a double-girder overhead crane whose two horizontal crane girders are connected to one another by means of head girders arranged at the respective ends thereof and can be moved together in a direction of travel extending transversely with respect to the longitudinal direction of the crane girders. Both crane girders are designed in a similar manner as trussed girders and include in each case plate-shaped upper runs, rod-shaped lower runs and rod-shaped posts.

German patent specification DE 31 09 834 C2 relates to a tower crane having a mast and a crane jib that are formed as trussed structures. The cuboidal mast includes four L-shaped and vertically oriented support girders, of which two adjacent support girders are each connected to one another by means of triangular plates. In this case, the plates are attached with their corner regions and/or one of their sides to the support girders. At least some of the sides of the plates are folded and form stiffening ribs.

Furthermore, German utility model DE 1 971 793 U1 discloses a crane girder of an overhead crane that is designed as a box girder. At its two opposite ends, the crane girder is screwed in each case to a head girder by means of connecting elements. The head girders support travelling mechanisms, with which the overhead crane can be moved along rails. The connecting plates are made up of a rectangular base plate, on which two rectangular fastening plates are welded in each case in an inwardly offset manner. The fastening plates are each positioned perpendicularly on the base plate and are arranged in parallel and at a spaced interval with respect to one another corresponding approximately to the width of the crane girder. Therefore, the connecting elements can be slid with their fastening plates over the ends of the crane girders, oriented and welded in the desired position.

SUMMARY OF THE INVENTION

The present invention provides a crane, in particular an overhead crane or gantry crane, having at least one improved crane girder.

According to one aspect of the invention, a crane, in particular an overhead crane or gantry crane, is provided which has at least one crane girder that extends horizontally and is designed or configured as a trussed girder having an upper run and a lower run, on which girder a crane trolley having a lifting gear can be moved. The crane girder has an adapter on at least one of its two opposite ends, which adapter can be fastened to the upper run and the lower run in such a way that the adapter can be oriented relative to the upper run and the lower run and then the adapter can be welded on the upper run and the lower run in a desired position.

Considerably reduced manufacturing outlay may be achieved with the crane girder of the present invention through the avoidance of subsequent machining that is generally necessary for crane girders that are initially produced at an excess size. It is also possible to avoid the optionally required welding of spacer plates. This also facilitates assembly. By virtue of the inventive structure and the use of the adapter that can be oriented, it is thus possible on the whole to achieve a reduction in production costs. Since the adapter can be moved with respect to the upper run and lower run in all spatial directions, not only the length of the crane girder but also the lack of manufacturing precision of the crane girder can be compensated for.

Provision can be made for the adapter to be oriented relative to the upper run and the lower run at least in one longitudinal direction of the crane girder. Therefore, the crane girder that is designed as a trussed girder does not have to be manufactured so precisely to length and twists or other inaccuracies of the crane girder can be taken into account when orienting and welding the adapter.

In a structurally simple design, it is provided that the crane girder includes an adapter on each of the two opposite ends. This allows for an increase in the length range by which the length of the crane girder can be adjusted.

In one form, it is provided that the adapter includes a connecting plate for fastening to a travelling mechanism, a head plate for fastening to the upper run and adapter walls for fastening to the lower run.

In one assembly step, the adapter can include adapter walls that are fastened to the head plate, without the connecting plate. Then, the head plate is placed horizontally on the upper run of the crane girder and, after orientation, is welded to the upper run in the desired position and after orientation the adapter walls terminating in the region of the lower run are welded to the lower run in the desired position. Alternatively, in this case the connecting plate can already be welded to the head plate and the adapter walls.

In another form, it is provided that two adapter walls extending in parallel and spaced apart from one another are arranged on the head plate.

In a further assembly step, it can be provided that a second orientation is effected by virtue of the fact that after orientation the connecting plate is welded to the already oriented head plate and the adapter walls in the desired position.

In still another form, it is also provided that a travelling mechanism can be fastened to each adapter via bores provided in the connecting plate.

In the case of a method for assembling a crane girder, which extends horizontally with a length and is designed as a trussed girder having an upper run and a lower run, for a crane, in particular an overhead crane or gantry crane, on which a crane trolley having a lifting gear can be moved, wherein the trussed structure of the crane girder is produced in one assembly step, the at least one crane girder may be improved by virtue of the fact that in a further assembly step an adapter is arranged on at least one of the two opposite ends of the crane girder, which adapter is oriented relative to the upper run and the lower run and then the adapter is welded in a desired position corresponding to a desired length on the upper run and the lower run. As a result, the adapter can be oriented in all spatial directions with respect to the upper run and lower run prior to welding, in order to compensate for any possible manufacturing inaccuracies.

In this case, it is provided that the adapter is oriented relative to the upper run and the lower run at least in one longitudinal direction of the crane girder. Therefore, the crane girder that is designed as a trussed girder does not have to be manufactured so precisely to length and twists or other inaccuracies of the crane girder can be taken into account when orienting and welding the adapter.

In one assembly step, it is provided that the adapter includes adapter walls fastened to a head plate with its head plate lying horizontally on the upper run of the crane girder is oriented and welded to the upper run in the desired position and the adapter walls terminating in the region of the lower run are oriented and welded to the lower run in the desired position. The adapter includes at least the head plate and adapter walls, and can thus connect the upper run and lower run and at the same time can be welded so as to be oriented in the space. In this case, a connecting plate for fastening the travelling mechanisms can already be fastened to the head plate and the adapter walls.

Alternatively, it is provided that after the head plate and the adapter walls have been oriented and welded and after taking into account with regard to entire length of the crane girder that the connecting plate is still missing, only then is the connecting plate oriented and welded in the desired position on the head plate and the adapter walls. Two consecutive orientation options are thus provided for the assembly.

In still another form, it is provided that an adapter is arranged, displaced and welded on each of the two opposite ends of the crane girder. In this case, each of the adapters can be attached in one step or two steps. It is preferred that at one end of the crane girder an adapter with a fastened connecting plate is used and at the other end of the crane girder an adapter without a fastened connecting plate is used. Dual-orientation is thus effected at one end.

These and other objects, advantages and features of this invention will become apparent upon review of the following specification in conjunction with the drawings.

DESCRIPTION OF THE PREFERRED EMBODIMENTS

The explanations given hereinafter with reference to overhead cranes also apply accordingly to gantry cranes.

Figure 1A:
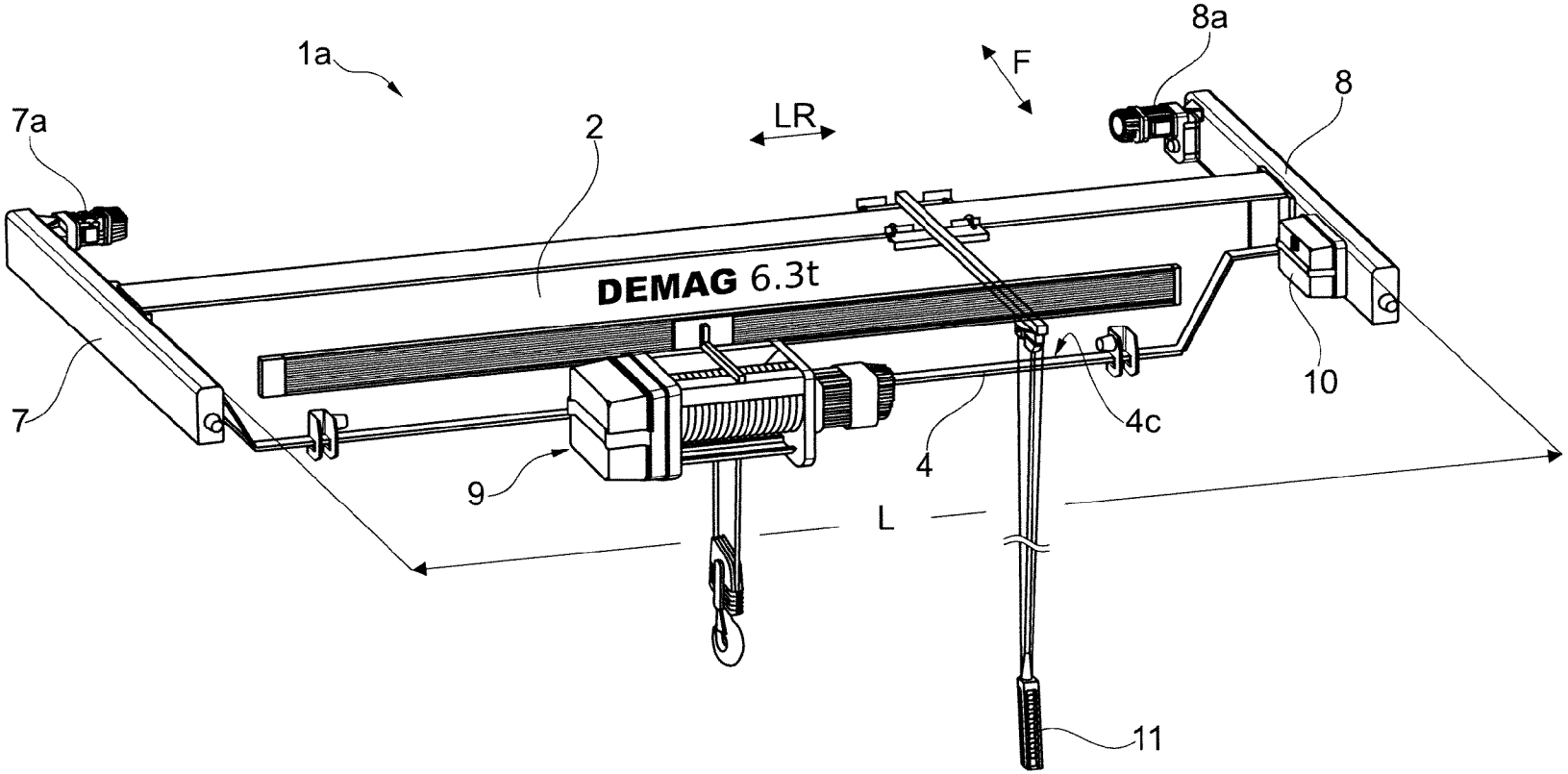
FIG. 1*a* is a perspective view of an overhead crane designed as a single-girder crane.

Referring now to the drawings and the illustrative embodiments depicted therein, a conventional first crane 1*a* is designed or configured as a single-girder overhead crane (FIG. 1*a*). It will be appreciated that, while first crane 1*a* is shown and described herein as an overhead crane, the present invention and this disclosure incorporate and are equally applicable to gantry cranes and the like. The first crane 1*a* includes a crane girder 2 that is designed as a box girder and is oriented horizontally and extends with a length L in its longitudinal direction LR. First and second travelling mechanisms 7, 8 are fastened to the opposite ends of the crane girder 2, so that a crane bridge is formed that is substantially double-T-shaped as seen in plan view. By means of the travelling mechanisms 7, 8, the first crane 1*a* can be moved in a horizontal direction of travel F transversely with respect to the longitudinal direction LR of the crane girder 2 on rails, not illustrated. The rails are typically arranged in a position above the ground and for this purpose can be elevated such as by means of a suitable support structure or can be fastened to opposite building walls. In order to move the first crane 1*a* or its crane girder 2, the first travelling mechanism 7 is driven by a first electric motor 7*a* and the second travelling mechanism 8 is driven by a second electric motor 8*a*. Suspended from the crane girder 2 is a crane trolley 9 that has a lifting gear designed as a cable winch and can be moved by means of travelling mechanisms, not illustrated, transversely with respect to the direction of travel F of the first crane 1*a* and along the longitudinal direction LR of the crane girder 2. The crane trolley 9 can be moved along and on laterally protruding running surfaces 4*c* of a lower run 4 of the crane girder 2. The first crane 1*a* also comprises a crane controller 10 and a pendant control switch 11 that is connected thereto and by means of which the first crane 1*a* or the electric motors 7*a*, 8*a* and the crane trolley 9 with the cable winch can be controlled and operated separately from one another.

Figure 1B:
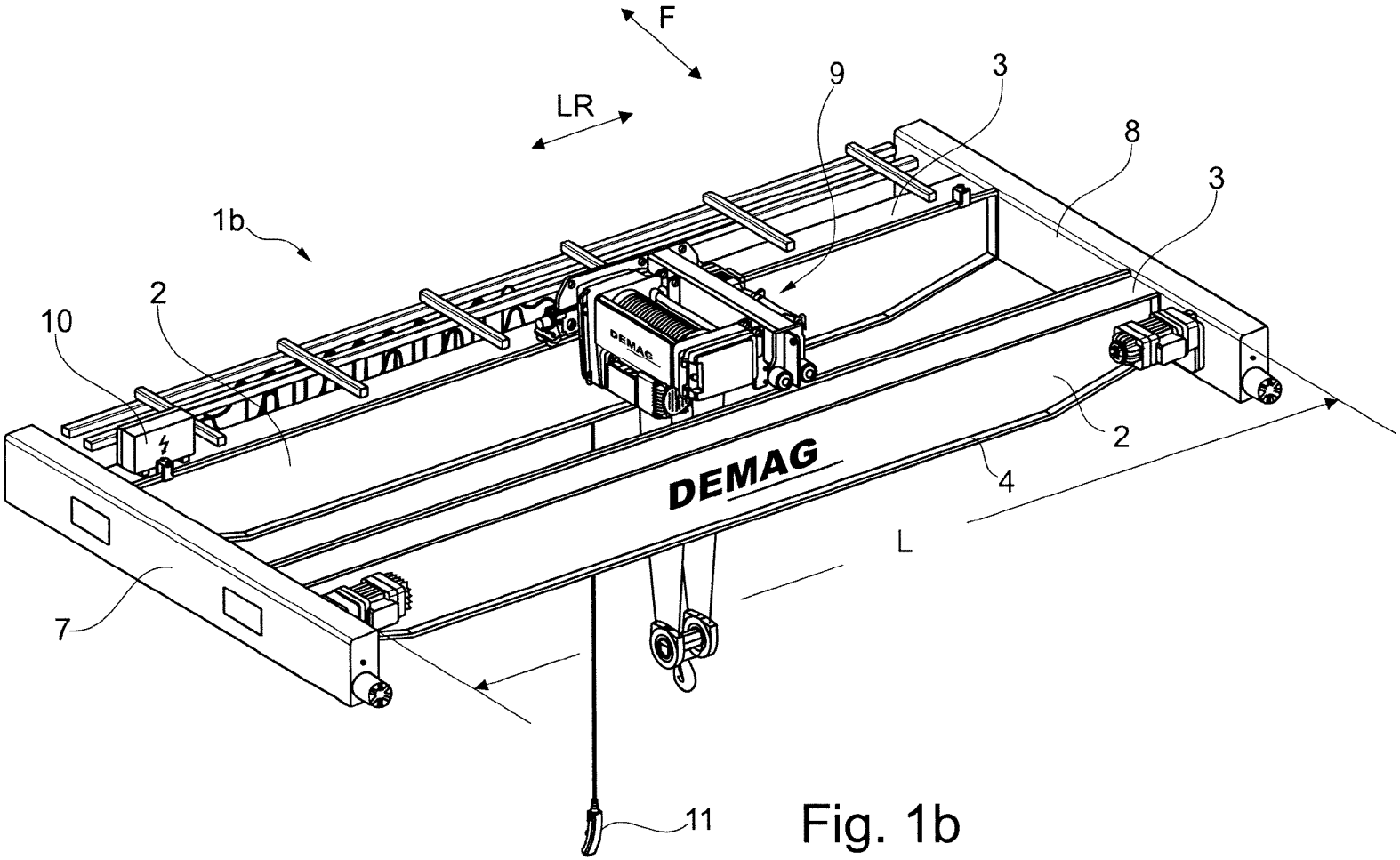
FIG. 1*b* is a perspective view of an overhead crane designed as a double-girder crane.

FIG. 1*b* shows a conventional second crane 1*b* that is designed as a double-girder overhead crane and includes two crane jibs 2 in comparison with the first crane 1*a* designed as a single-girder overhead crane. Fastened to the ends of the two crane girders 2 are, again, travelling mechanisms 7, 8, so that a frame is formed as seen in plan view. The second crane 1*b* also includes a crane trolley 9 having a lifting gear designed as a cable winch. However, the crane trolley 9 is not suspended from the lower runs 4 of the crane girders 2, but rather runs on upper runs 3 of the two crane girders 2. Accordingly, the crane trolley 9 is arranged centrally between crane girders 2 and can be moved along the longitudinal direction LR of the crane girders 2 and between the two crane girders 2. In this case, a load picking-up means of the cable winch arranged on the crane trolley 9 can be lowered or raised between the two crane girders 2.

For the purposes of this description, it will be understood that the statements given with respect to the first crane 1*a* apply accordingly for the second crane 1*b*.

Figure 2A:
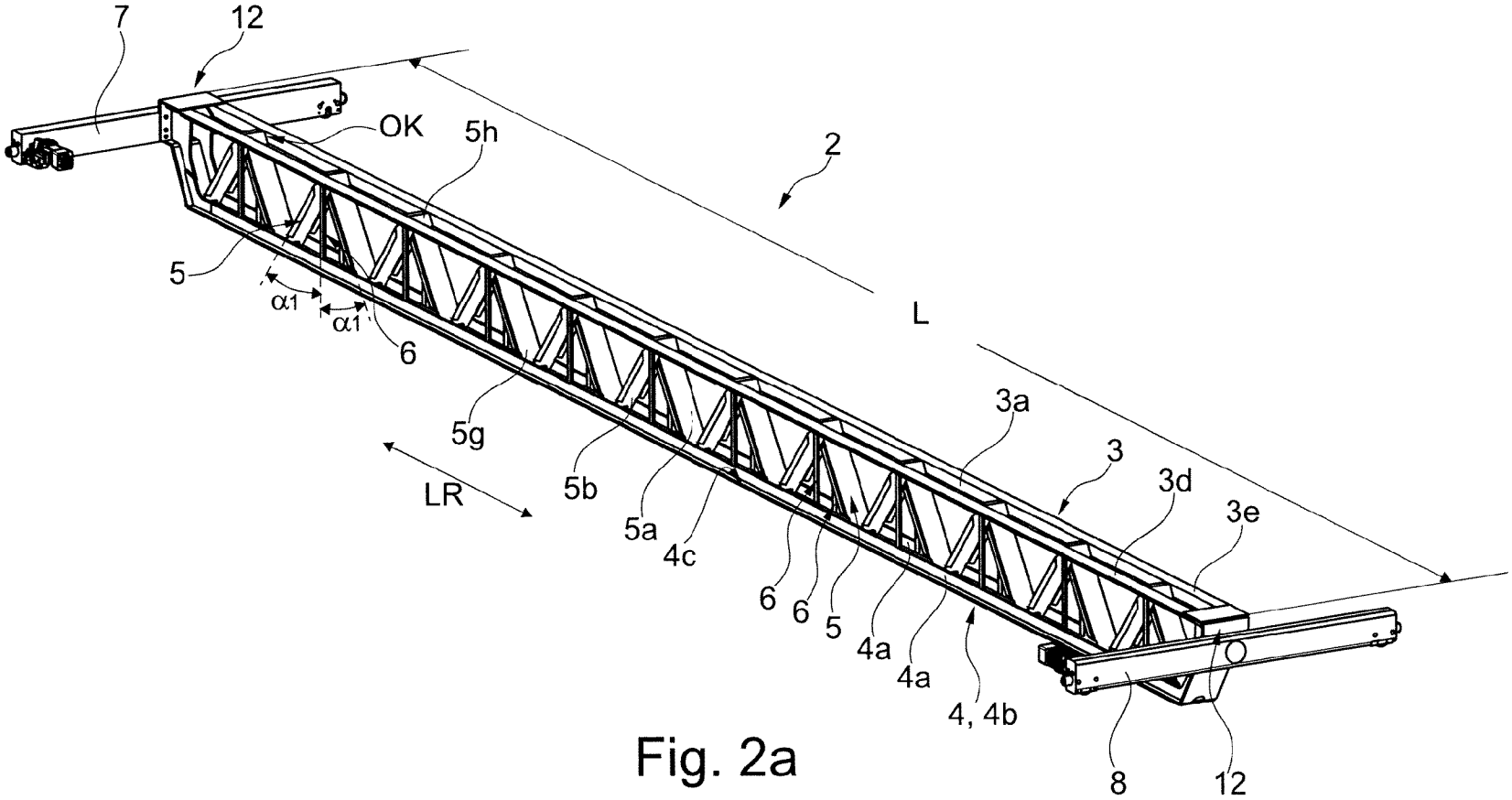
FIG. 2*a* is a perspective view of a crane girder in accordance with the present invention, which is compatible for use in the overhead crane of FIG. 1*a;*

FIG. 2*a* shows a perspective view of an inventive crane girder 2 for a crane 1*a* that is designed in accordance with FIG. 1*a* as a single-girder overhead crane. In this case, the crane girder 2 is not designed conventionally as a box girder but rather as a trussed girder.

The trussed structure of the crane girder 2 includes an upper run 3, a lower run 4, diagonally extending struts 5 and vertical posts 6. The upper run 3 and the lower run 4 extend in each case in a linear manner, in parallel and spaced apart from one another in the longitudinal direction LR of the crane girder 2 between the travelling mechanisms 7, 8. In this case, the upper run 3 and the lower run 4 are vertically spaced apart from one another. The upper run 3 is composed of two first and second upper run profiles 3*d*, 3*e* that are arranged in a horizontal plane and are horizontally spaced apart from one another.

The two upper run profiles 3*d*, 3*e* are formed by an L- or angle-profile girder. The lower run 4 is formed by a flat profile 4*b* having two perpendicularly standing limbs 4*a*, so that approximately a U-profile-shaped cross-section is provided. In this case, the flat profile 4*b* is extended laterally beyond the limbs 4*a* (see also FIG. 3). The lateral extensions of the flat profile 4*b* each form a running surface 4*c* for travelling mechanisms of the crane trolley 9, not illustrated here. Moreover, the spaced interval of the outermost edges of the upper run profiles 3*d*, 3*e* or of the flat profile 4*b*, as seen in the longitudinal direction LR, produces a width B of the crane girder 2.

The upper run 3 and the lower run 4 are connected to one another by means of a plurality of struts 5, which are formed in a laminar manner, and a plurality of posts 6 that in one embodiment are formed in a rod-shaped manner. In this case, the struts 5 are formed as a sheet metal profile having a main surface 5*a* with a substantially rectangular cross-section, wherein the longitudinal sides thereof are overturned in the form of auxiliary surfaces 5*b* to increase the buckling strength at least in a central region.

The trussed structure of the crane girder 2 is terminated at the opposite ends of the upper run 3 and of the lower run 4 by means of an adapter 12 in each case. By means of these adapters 12, the upper run 3 and the lower run 4 are connected to form a frame. Since the lower run 4 is, on the whole, shorter than the upper run 3, the adapter 12 has a diagonal progression and on the whole, the frame of the crane girder 2 is extended from the bottom to the top and is formed in a trapezoidal manner. Moreover, in the region of the upper run 3 and on the side facing away from the upper run 3, the adapter 12 includes a connecting plate 12*a*, to which one of the travelling mechanisms 7, 8 or the girder thereof is fastened.

Starting from one of the two adapters 12 as seen in the longitudinal direction LR of the crane girder 2, a first strut 5 is connected to the lower run 4 and extends in the longitudinal direction LR inclined at a first setting angle $\alpha 1$ in the direction of the upper run 3 and is fastened at that location in an upper node point OK. In this case, the first setting angle $\alpha 1$ is enclosed by the first strut 5 and a post 6 terminating in the upper node point OK. For example, the first setting angle $\alpha 1$ may be in a range of 35° to 55° and in particular may preferably be 45°. In the upper node point OK, a second strut 5 adjoins that extends obliquely at the setting angle $\alpha 1$ downwards to the lower run 4. This is repeated until the struts 5 reach the opposite end of the crane girder 2. In this case, an even number of struts 5 is used so that the last strut 5 terminates at the lower run 4. Depending upon the length L of the crane girder 2, prior to assembly the setting angle $\alpha 1$ is determined, so that an even number of struts 5 is used that each have the same length and are at the same setting angle $\alpha 1$. Moreover, in the region of each upper node point OK a post 6 is additionally fastened that extends vertically with respect to the lower run 4 and is fastened at this location. As a consequence, the lower run 4 that serves as a rail and for this purpose forms the running surface 4*c* is reinforced to protect it against bending.

The struts 5 are oriented within the trussed structure of the crane girder 2 such that in each case their main surface 5*a* extends transversely with respect to the longitudinal direction LR of the crane girder 2. Moreover, the struts 5 are arranged with their lower first strut ends 5*g* between the upwardly pointing limbs 4*a* of the lower run 4. At their upper second strut ends 5*h*, the struts 5 are arranged between the two upper run profiles 3*d*, 3*e*, wherein the upper run profiles 3*d*, 3*e* are welded, with the inner sides of their limbs 3*a* oriented vertically in a flush manner with respect to the limbs 4*a* of the lower run 4 (see FIG. 3), to the struts 5. The rod-shaped posts 6 are also arranged between the limbs 4*a* of the lower run 4 and the limbs 3*a* of the upper run profiles 3*d*, 3*e* and are welded with the inner sides thereof. As seen transversely with respect to the longitudinal direction LR of the crane girder 2, only one strut 5 is provided between the limbs 3*a*, 4*a* of the upper run 3 or lower run 4.

FIG. 2*a* also shows that in each case two vertical posts 6 are arranged between two struts 5 that extend obliquely or diagonally in the manner of a pitched roof. The struts 5 and posts 6 that are allocated to one another in this way impinge upon one another at a common upper node point OK on the upper runs 3, wherein each strut 5 together with the associated post 6 in the region of the corresponding upper node point OK on the upper runs 3 forms a first setting angle $\alpha 1$ of equal size. Therefore, by reason of the even number of struts 5 arranged correspondingly in pairs, the last strut 5 descends towards the lower run 4 at both ends of the crane girder 2.

Furthermore, the crane girder 2 can be adjusted by adapters 12 (see also FIG. 4) in a dimensionally accurate manner to the length L, in that the adapters 12 are slid onto the opposite ends of the upper run 3 of the crane girder 2, are then displaced accordingly in the longitudinal direction LR thereof and finally are welded to the crane girder 2.

Figure 2B:
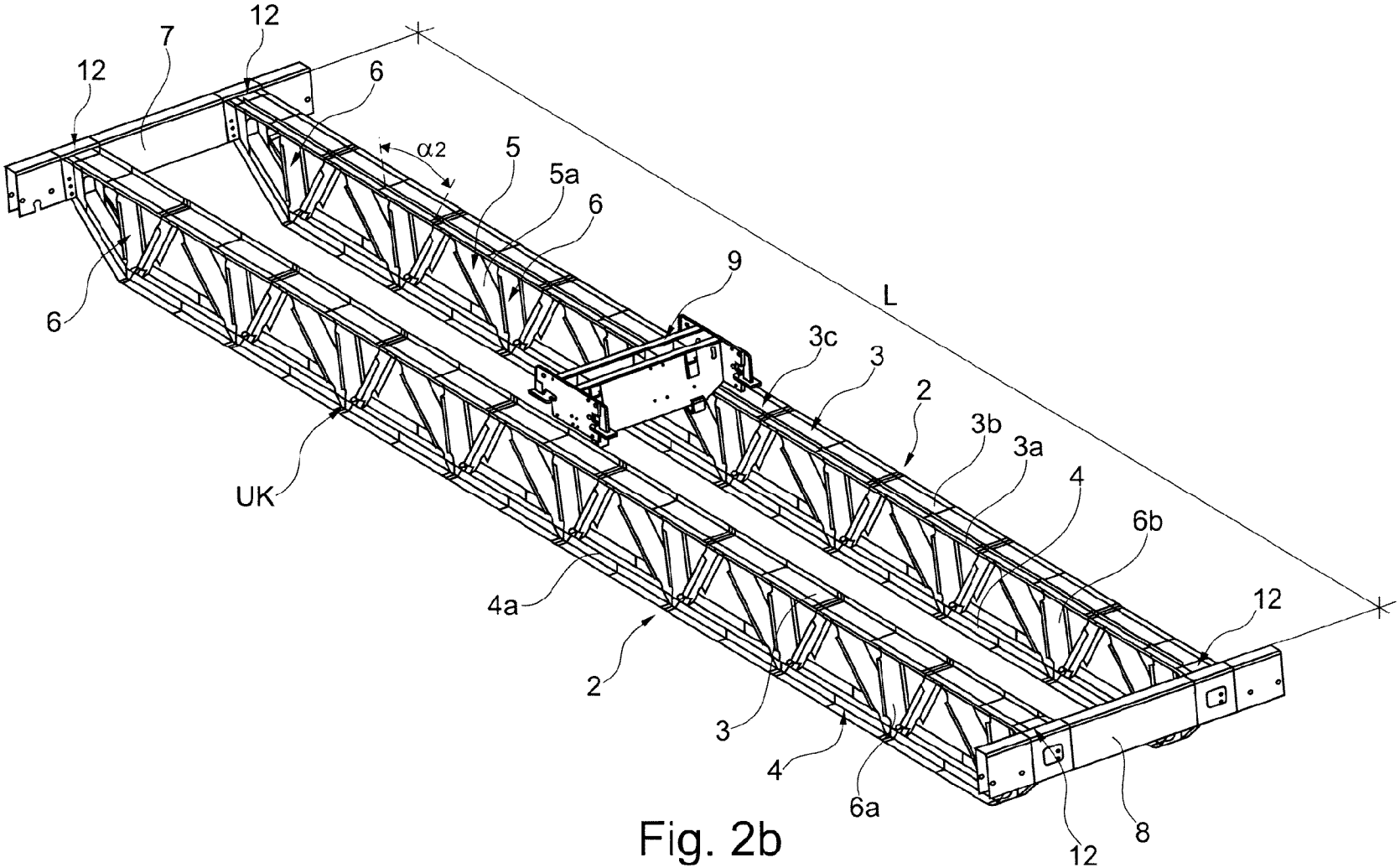
FIG. 2*b* is a perspective view of two crane girders in accordance with the present invention, which are compatible for use with the overhead crane of FIG. 1*b;*

FIG. 2*b* illustrates a perspective view of two crane girders 2, which are designed in accordance with the invention as trussed girders, for a crane 1*b* designed in accordance with FIG. 1*b* as a double-girder overhead crane. Both crane girders 2 are adjusted by means of adapters 12, which are slid on at opposite ends thereof (see also FIG. 4), to the desired length L and are arranged spaced apart from one another in parallel. The travelling mechanisms 7, 8 that are also illustrated are fastened to the ends of the two crane girders 2 by means of the adapters 12.

The trussed structures of the two crane girders 2 of the second crane 1*b* comprise, again, a lower run 4 and an upper run 3 longer than the lower run, which runs are each formed in one piece in the same way as the lower run 4 of the first crane 1*a*. Accordingly, the upper run 3 of each crane girder 2 is formed by a flat profile 3*b* having limbs 3*a* with an approximately U-profile-shaped cross-section. The downwardly directed limbs 3*a* of the flat profiles 3*b* of the upper runs 3 and the upwardly directed limbs 4*a* of the flat profiles 4*b* of the lower runs 4 are mutually facing.

The upper run 3 of each crane girder 2 is connected to the associated lower run 4 by means of a plurality of struts 5 formed in a laminar manner and a plurality of posts 6 that in a second embodiment are likewise formed in a laminar manner and are vertically oriented. The basic structure of the laminar posts 6 that are formed in this second embodiment corresponds—with correspondingly adapted measurements—substantially to the structure of the laminar struts 5. However, instead of two rod-shaped posts 6 only one laminar post 6 is arranged between two adjacent struts 5. In this case, each post 6 that is formed in the laminar second embodiment extends with a main surface 6*a* transversely with respect to the longitudinal direction LR of the crane girder 2 and with auxiliary surfaces 6*b*, which are folded at a right angle thereto, in this longitudinal direction LR. The laminar posts 6 can also be arranged or oriented in such a manner that the auxiliary surfaces 6*b* point towards or away from one of the ends of the crane girder 2.

However, it is fundamentally also possible to provide the crane girders 2 of the first crane 1*a*, which is designed as a single-girder crane, with the laminar posts 6 that are formed in the second embodiment.

The struts 5 are identical for the two crane girders 2 of the second crane 1*b*, i.e. as in the case of the first crane 1*a* in accordance with FIG. 1*a* they are formed in a mirror-symmetrical manner in relation to their longitudinal axis LA.

It is also indicated in FIG. 2*b* that the crane trolley 9 for the cable winch, not illustrated, is not suspended from the lower runs 4 of the crane girders 2 but rather is attached to their upper runs 3. For this purpose, a running rail having a corresponding running surface 3*c* is provided, preferably centrally, on each of the two upper runs 3, so that the crane trolley 9 is arranged between the crane girders 2 and can be moved accordingly, as illustrated in FIG. 1*b*, in the longitudinal direction LR between the travelling mechanisms 7, 8 of the second crane 1*b*.

Furthermore, it is evident in FIG. 2*b* that the struts 5 are arranged in the manner of a pitched roof in the same manner as in the case of the crane girder 2 shown in FIG. 2*a*. However, in this case two adjacent struts 5 are allocated only one post 6, which is formed in a laminar manner, such that struts 5 and the post 6 impinge upon one another at a common lower node point UK on the lower runs 4. Therefore, each strut 5, together with the associated laminar post 6 in the region of the corresponding lower node point UK on the lower runs 4, forms an identically large second setting angle $\alpha 2$ that, just like the first setting angle $\alpha 1$, is optionally in a range of 35° to 55° and in a particularly preferred manner may be 45°. Therefore, by reason of the even number of struts 5 arranged correspondingly in pairs the last strut 5 descends towards the lower run 4 at both ends of the crane girder 2. However, unlike in the case of the crane girder 2 shown in FIG. 2*a*, a laminar post 6 is also arranged at each end of the crane girder 2 after the last strut 5.

Figure 3:
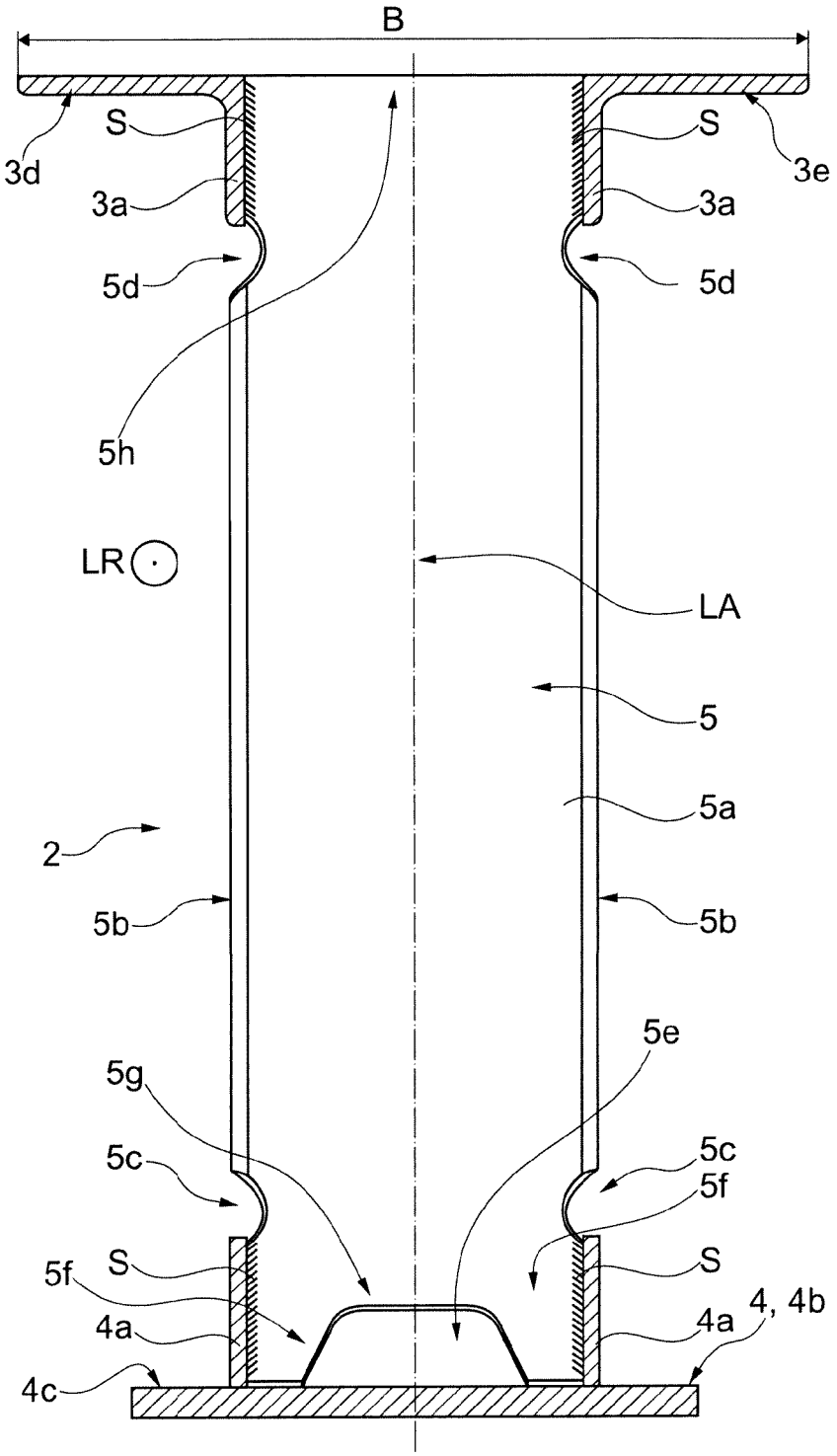
FIG. 3 is a cross-sectional end view of the crane girder of FIG. 2*a,*

FIG. 3 shows a cross-sectional view of the crane girder 2 in accordance with FIG. 2*a*. FIG. 3 shows in particular the basic structure of the struts 5 that corresponds substantially to the basic structure of the posts 6 that are likewise formed in a laminar manner in the second embodiment but can differ therefrom in terms of dimensions. Accordingly, the statements in relation to FIG. 3 also apply to the crane girders 2 shown in FIG. 2*b* and to the posts 6 used in this case in the laminar second embodiment. For the sake of simplicity, with respect to the description of FIG. 3 reference is made only to the struts 5; the reference numerals 5*a* to 5*h* mentioned in this case similarly designate the corresponding elements of the laminar posts 6 that are indicated at the same points as reference numerals 6*a* to 6*h* and are listed in the list of reference numerals.

The strut 5 illustrated in FIG. 3 and formed in a laminar manner has an elongated shape with a substantially rectangular main surface 5*a*. The main surface 5*a* extends along the longitudinal axis LA of the strut 5 and in each case in a central region over at least half the width B of the crane girder 2 in a transverse manner with respect to the longitudinal direction LR of the crane girder 2, in particular over at least half the distance between the inner sides of the limbs 3*a* or the limbs 4*a*. The struts 5 can be produced by laser cutting from a steel sheet. Moreover, the struts 5 have a lower first strut end 5*g* and a lower second strut end 5*h*. In particular, two strut feet 5*f* are formed on the lower first strut end 5*g* in the region of the lower corners of the strut 5, in that an aperture 5*e* is provided centrally on the lower first strut end 5*g* in the main surface 5*a*. The aperture 5*e* has a mirror-symmetrical and approximately trapezoidal cross-section in relation to the longitudinal axis LA. The struts 5 are inserted with their lower first strut ends 5*g* between the upwardly pointing limbs 4*a* of the lower run 4. In this case, the strut feet 5*f* lie with their longitudinal sides of the main surface 5*a*, which extend between the lower recesses 5*c* and the lower first strut end 5*g*, against the inner sides of the limbs 4*a* of the lower run 4 and are welded to the limbs 4*a*. However, the strut feet 5*f* do not lie on the flat profile 4*b* of the lower run 4. It is also evident in FIG. 3 that the two upper run profiles 3*d*, 3*e* lie with their vertical limbs 3*a* against the corresponding longitudinal sides of the main surface 5*a* that extend between the upper recesses 5*d* and the upper second strut end 5*h*, and that a welding connection is established at that location.

It is also feasible for the limbs 3*a*, 4*a* not to be spaced equally far apart from one another. Accordingly, the outer longitudinal sides of the strut ends 5*g*, 5*h*, in particular also of the strut feet 5*f*, are then spaced at different distances from one another, in order to be able to lie against the limbs 3*a*, 4*a*, which are arranged vertically in a non-aligned fashion, and to be able to be welded thereto.

In the region of their opposite lower first and upper second strut ends 5*g*, 5*h*, two lower recesses 5*c* and two upper recesses 5*d* are provided on both longitudinal sides of the strut 5. The lower and upper recesses 5*c*, 5*d* adjoin the limbs 3*a*, 4*a* of the upper and lower runs 3, 4 in each case, in order to relieve the load on the weld seam S or the associated weld seam run-out. The recesses 5*c*, 5*d* are circular in formation, and may preferably be circular arc-shaped.

Between the lower and upper recesses 5*c*, 5*d*, an auxiliary surface 5*b* that is folded at a right angle and extends in parallel with the longitudinal axis LA adjoins the main surface 5*a* at each longitudinal side of the strut 5. The auxiliary surfaces 5*b* are formed substantially in a trapezoidal manner. By virtue of the fact that the auxiliary surfaces 5*b* are both folded in the same direction, the strut 5 illustrated in FIG. 3 has, at least in the region of the auxiliary surfaces 5*b*, a U-shaped cross-section as seen in the direction of the longitudinal axis LA of the strut 5. It is likewise feasible for the auxiliary surfaces 5*b* to be folded in opposite directions, so that, as seen in the direction of the longitudinal axis LA, a Z-shaped cross-section would be produced at least in part. By omitting an auxiliary surface 5*b* or by providing merely one single auxiliary surface 5*b*, the strut 5 can also comprise in a corresponding manner an at least partially L-shaped cross-section as seen in the direction of the longitudinal axis LA. The auxiliary surfaces 5*b* serve to increase the buckling strength of the struts 5. The auxiliary surfaces 5*b* are located outside the limbs 3*a*, 4*a*, so that only the non-overturned regions of the longitudinal sides of the main surfaces 5*a* are welded to the limbs 3*a*, 4*a*.

In one possible embodiment, the total length of a strut is 890 mm. In this case, the longitudinal sides of the lower first and upper second strut ends 5*g*, 5*h* are each inserted with an insertion length of 80 mm between the limbs 3*a*, 4*a* of the upper and lower runs 3*a*, 4*a* or are welded to the limbs 3*a*, 4*a* over said length. The spaced interval between the inserted regions of the longitudinal sides and the auxiliary surfaces 5*b*, i.e. the length of the membrane joints formed in this region, is then 100 mm in each case. Accordingly, the auxiliary surfaces 5*b* have an auxiliary surface length of 530 mm in relation to the longitudinal axis LA, i.e. auxiliary surfaces 5*b* extend in their longitudinal direction over the auxiliary surface length of 530 mm.

The auxiliary surface lengths are thus preferably in a range of about 40% to 70% of the total length of the strut 5, and the insert lengths are in a range of about 5% to 15% of the total length of the strut 5.

Figure 4A:
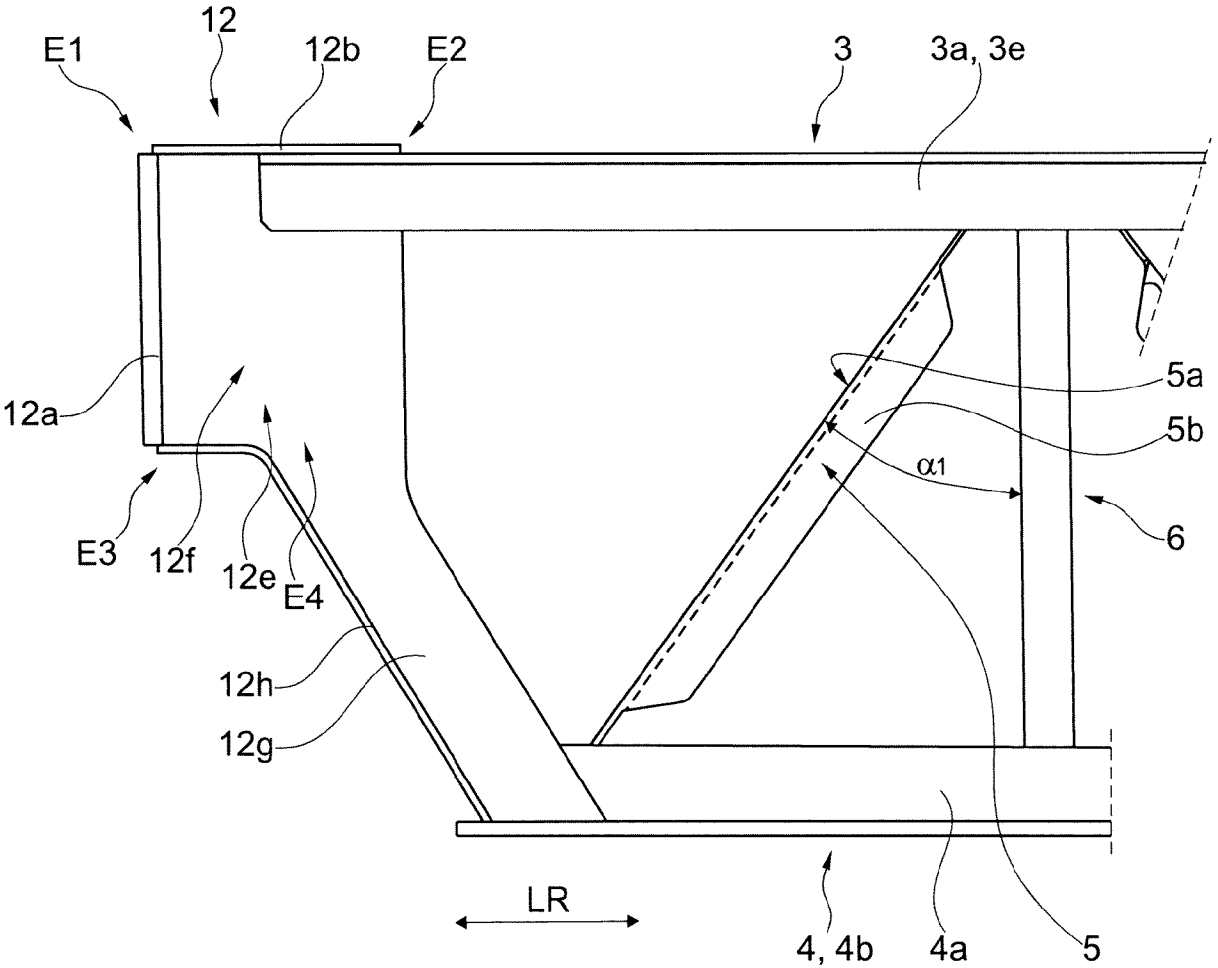
FIG. 4*a* is a side elevation of an adapter for the crane girder.

FIG. 4*a* shows a side view of one of the two adapters 12 that are arranged on the opposite ends of a crane girder 2 for the first crane 1*a*. The crane girder 2 is designed as a trussed girder having two upper run profiles 3*d*, 3*e*. Also shown is a strut 5 that is positioned at the first setting angle $\alpha 1$ with respect to the rod-shaped post 6.

FIG. 4*a* also shows the trapezoidal formation of an auxiliary surface 5*b* of the strut 5 that is folded from the main surface 5*a*. The auxiliary surface 5*b* is arranged outside the limbs 3*a*, 4*a* of the upper and lower runs 3, 4 and extends in a vertical plane that includes the longitudinal direction LR of the crane girder 2.

In order to adjust the desired length L of the crane girders 2, the adapter 12 is placed against the upper run 3 and the lower run 4, oriented in the longitudinal direction LR and welded. For each adapter, changes in length of ±5 millimeters in the longitudinal direction LR can be achieved. Accordingly, the crane girder 2 already has almost the desired length L prior to attachment of the adapters 12. In this case, the construction of the adapter 12 is selected such that it can be displaced for fine-adjustment of the length L relative to the upper run profiles 3*d*, 3*e* and the lower run prior to welding. During this fine-adjustment, other manufacturing tolerances of the crane girder 2, such as twists and bends, can also be compensated for. For this purpose, the adapter 12 can be displaced not only relative to the longitudinal direction LR but also can be rotated about a vertical axis and can be rotated about a horizontal axis oriented transversely with respect to the longitudinal direction LR, before it is welded to the upper run 3 and the lower run 4.

The end of the crane girder 2 illustrated in FIG. 4*a* shows the termination of the trussed structure, wherein the two upper run profiles 3*d*, 3*e* of the upper run 3 are connected to the lower run 4 to form a frame. For this purpose, the adapter 12 has two identically formed, rib-like adapter walls 12*e* that extend in the longitudinal direction LR and are connected at their upper and lower ends to the limbs 3*a*, 4*a*. In this case, the adapter walls 12*e* are spaced apart from one another and are arranged in parallel with one another and in parallel with the limbs 3*a*, 4*a* and point with their surfaces accordingly in a transverse manner with respect to the longitudinal direction LR of the crane girder 2.

Each adapter wall 12*e* includes a head part 12*f* that is formed substantially as a rectangular and planar plate and has four corners E1 to E4. At the upper sides of the adapter walls 12*e* that connect the upper first corner E1 and the upper second corner E2, a horizontally oriented head plate 12*b* is placed onto the adapter walls 12*e* and welded thereto. The head plate 12*b* is formed in a planar and rectangular manner. The vertically oriented connecting plate 12*a* is fastened to the connecting side of the adapter walls 12*e* that connects the first corner E1 to the third corner E3 arranged vertically below it. The connecting plate 12*a* is also formed in a planar and rectangular manner, wherein the connecting plate 12*a* protrudes laterally beyond the adapter walls 12*e* as seen in the longitudinal direction LR. The connecting plate 12*a* and the head plate 12*b* are thus arranged substantially at right angles to one another and impinge upon one another in the region of the first corner E1. In the region of a fourth corner E4 lying diagonally opposite the first corner E1, the head part 12*f* of the adapter walls 12*e* changes into a connecting limb 12*g*. The connecting limbs 12*g* adjoin the head part 12*f* of the respective adapter wall 12*e* in this case extending diagonally or obliquely downwards in a manner directed away from the connecting side of the adapter walls 12*e*. The connecting limbs 12*g* are flat and elongate in formation and thus resemble, in terms of their basic structure, substantially the structure of the limbs 3*a*, 4*a* of the upper run 3*a* or the lower run 4*a*.

In the case of an adapter 12 attached to the corresponding end of the crane girder 2, the connection to the lower run 4, which is formed to be shorter than the upper run 3, is possible by reason of the diagonal progression of the connecting limbs 12*g*. In this case, the dimensions of the adapter walls 12*e*, in particular in terms of their head parts 12*f* and their connecting limbs 12*g*, are selected in dependence upon the spaced interval between the upper run 3 and the lower run 4 such that the connecting limbs 12*g* reach the lower run 4 and in this case lie outside the limbs 4*a* against the outer sides thereof such that they can still be connected or welded together laterally. Unlike in the case of the upper and lower runs 3, 4 in FIG. 3, the limbs 3*a* of the upper run 3 in FIG. 4*a* are thus not oriented in each case in a vertically aligned manner with the limbs 4*a* of the lower run 4 but rather the limbs 3*a* are spaced further apart from one another in the horizontal direction than the limbs 4*a*. Therefore, the connecting strut 12*g* arriving at the lower run 4 and the last strut 5 can also intersect inside or outside the respective limb 4*a*.

However, it is likewise possible for the limbs 3*a*, 4*a* to be arranged with respect to one another as shown in FIG. 3 and for the lower ends of the connecting limbs 12*g* to be inserted a corresponding distance between the limbs 4*a* thereof in order to be able to be connected thereto. Accordingly, the adapter walls 12*e* are arranged so as to be spaced so far apart from one another that in the region of the head parts 12*f* they lie with their outer sides in a two-dimensional manner against the inner sides of the limbs 3*a*, 3*b* of the upper run profiles 3*d*, 3*e* of the upper run 3 or the lower run 4 in the same way as they lie against the lower free ends of the connecting limbs 12*g*.

It is likewise feasible that in the case of limbs 3*a*, 4*a* which are not spaced equally apart from one another, the adapter plates 12 lie with their head parts 12*f* between the limbs 3*a* of the upper run 3, but with their connecting limbs 12*g* outside the limbs 4*a* of the lower run 4 against the outer sides thereof.

In order to ensure that the adapter 12 or its correspondingly mutually spaced-apart adapter walls 12*e*, in particular their connecting limbs 12*g*, acquire adequate stiffness and stability, a closure plate 12*h* is provided at the lower sides of the adapter walls 12*e*. The closure plate 12*h* extends starting from the third corner E3 of the head part 12*e* in the direction of the fourth corner E4 initially horizontally and then follows in a diagonally downward manner the progression of the connecting limbs 12*g* until it terminates at the lower run 4. The closure plate 12*h* that is formed so as to be angled in this manner is welded to the lower sides of the adapter walls 12*e*. Moreover, a substantially rectangular recess 12*i* is provided at an end of the closure plate facing away from the head parts 12*f*.

Adaptation to the desired length L of a crane girder 2 is also possible if, contrary to the illustration in FIG. 4*a*—as for example in the case of the second crane 1*b*—each crane girder 2 includes an upper run 3 having a flat profile 3*b*. In the case of an upper run 3 that is formed in one piece as a flat profile 3*b*, the adapter walls 12*e* are so far set back below the head plate 12*b* that the adapter 12 lies with only its head plate 12*b* on the upper run 3. The adapter walls 12*e* then no longer lie laterally against the limbs 3*a*, 4*a*.

In order to complete the length of the crane girder 2 and compensate for any manufacturing tolerances thereof, the adapter 12 is slid onto an end of the crane girder 2, wherein its head plate 12*b* lies two-dimensionally on the upper sides of the upper run 3 or the two upper run profiles 3*d*, 3*e*. The length L that is to be adjusted and any required rotations about the previously described horizontal and vertical axes are defined by connecting surfaces 12*c* of the connecting plates 12*a* arranged on the two ends of the crane girder 2, wherein the connecting surfaces 12*c* point opposite one another away from the upper runs 3. Finally, the length L and orientation are adjusted in a dimensionally accurate manner, in that the adapter 12 that lies with the head plate 12*b* on the upper run 3 is, in the longitudinal direction LR, displaced and rotated accordingly. In order to fix the length L and orientation adjusted in this manner, the adapter 12 is then welded to the upper run 3 and the lower run 4.

However, it is likewise possible initially to slide an adapter 12 without a connecting plate 12*a* onto the end of the crane girder and to adjust the length L and orientation. The dimension of the connecting plate 12*a*, which is still to be fastened, is taken into account in this case. The connecting plate 12*a* is then finally welded on, in order to orient the two opposite connecting plates 12*a* additionally with one another, as the connecting plates 12*a* are already provided with bores 12*d*, via which the travelling mechanisms 7, 8 are fastened to the adapters 12 and thus to the corresponding crane girder 2. The connecting plate 12*a* can be displaced horizontally and vertically relative to the head plate 12*b* and the adapter walls 12*e* for orientation purposes and can be rotated about the longitudinal direction LR of the crane girder 2. For this purpose, the connecting plate 12*a* lies, from the side, against the head plate 12*b* and the adapter walls 12*e*, before they are welded after orientation. Optionally, an adapter 12 already has a fastened connecting plate 12*a*. The opposite adapter 12 is oriented and welded in two steps—firstly the head plate 12*b* with the adapter walls 12*e* connected thereto, then followed by the connecting plate 12*a*.

Figure 4B:
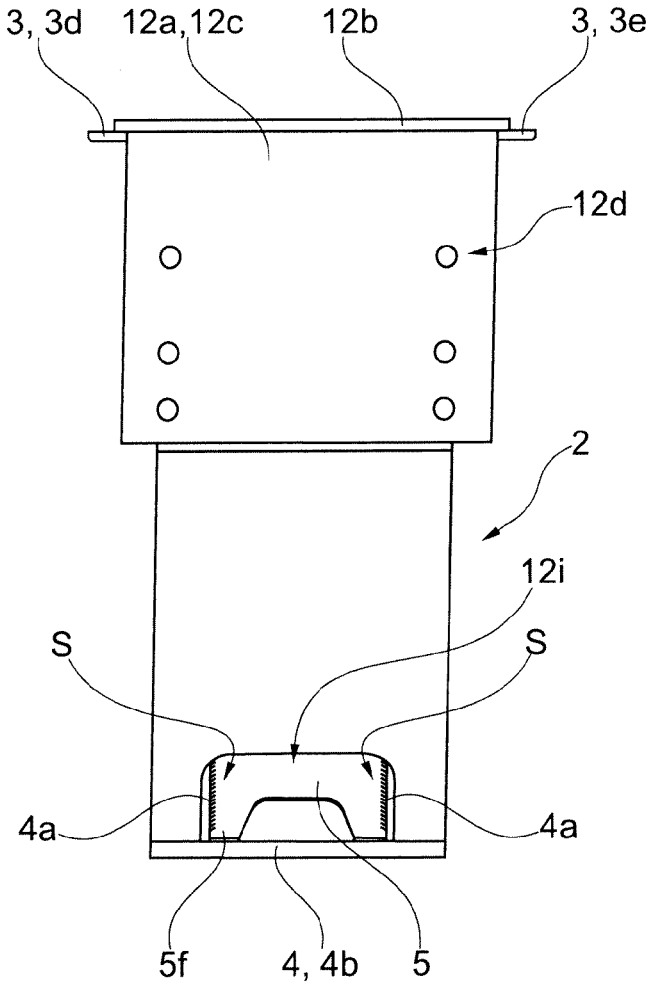
FIG. 4*b* is an end elevation view of the adapter as seen in the longitudinal direction of the crane girder.

FIG. 4*b* shows a view of the adapter 12, which is slid onto one end of the crane girder 2, as seen in the longitudinal direction LR of the crane girder 2. It is apparent that the horizontally oriented head plate 12*b* of the adapter 12 lies on the upper run 3 or the upper run profiles 3*d*, 3*e* thereof. This is adjoined by the vertically oriented connecting plate 12*a* with the bores 12*d* for fastening one of the travelling mechanisms 7, 8, not illustrated here. Arranged below the connecting plate 12*a* is the closure plate 12*h*, on whose end facing towards the lower run 4 the recess 12*i* is provided. Through the recess 12*i* it is possible to see a strut 5 that is inserted with its strut feet 5*f* between the limbs 4*a* of the flat profile 4*b* of the lower run 4. Indicated on the outer longitudinal sides of the strut feet 5*f* is in each case one of the weld seams S, by means of which the strut 5 is fastened to the lower run 4.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A crane comprising:

at least one crane girder extending horizontally and configured as a trussed girder having an upper run having an upper run length, a lower run having a lower run length that is shorter than the upper run length, and two opposite ends;

a crane trolley having a lifting gear, wherein the crane trolley is movable along the crane girder;

wherein the crane girder comprises:

an adapter on at least one of the two opposite ends;

a travelling mechanism fastened to the adapter; and wherein the adapter is positioned on the upper run and the lower run, and oriented relative to the upper run and the lower run in a desired position, and the adapter is coupled directly to the upper run and the lower run via welds;

wherein the adapter comprises:

a vertically oriented connecting plate for fastening to the travelling mechanism of the crane girder;

a head plate for fastening to the upper run of the crane girder; and adapter walls each having a respective lower end portion fastened to the lower run and a respective upper end portion fastened to the upper run via the head plate;

wherein the adapter walls each comprise a connecting limb extending diagonally from the upper run to the lower run, wherein the head plate lies horizontally on the upper run of the crane girder and is coupled via a weld to the upper run in the desired position, the connecting limbs of the adapter walls terminate in the region of the lower run, and the connecting limbs of the adapter walls are coupled via welds to the lower run in the desired position.

2. The crane as claimed in claim 1, wherein the crane girder comprises two adapters, wherein one of the two adapters is arranged on each of the two opposite ends.

3. The crane as claimed in claim 2, wherein the connecting plate lies against the head plate and the adapter walls, and the connecting plate is secured in the desired position via a weld.

4. The crane as claimed in claim 2, wherein bores are provided in the connecting plate for fastening the travelling mechanism to each adapter.

5. The crane as claimed in claim 1, wherein two of the adapter walls extend in parallel and are spaced apart from one another, and are arranged on the head plate.

6. The crane as claimed in claim 5, wherein bores are provided in the connecting plate for fastening the travelling mechanism to each adapter.

7. The crane as claimed in claim 1, wherein the connecting plate lies against the head plate and the adapter walls, and the connecting plate is secured in the desired position via a weld.

8. The crane as claimed in claim 1, wherein bores are provided in the connecting plate for fastening the travelling mechanism to each adapter.

9. The crane as claimed in claim 1, wherein two of the adapter walls extend in parallel and are spaced apart from one another, and are arranged on the head plate.

10. The crane as claimed in claim 9, wherein the connecting plate lies against the head plate and the adapter walls, and the connecting plate is secured in the desired position via a weld.

11. The crane as claimed in claim 10, wherein bores are provided in the connecting plate for fastening the travelling mechanism to each adapter.

12. The crane as claimed in claim 1, wherein the crane is an overhead crane or a gantry crane.

13. A method for assembling a crane girder for a crane, the method comprising:

producing a trussed structure of the crane girder in one assembly step, wherein the crane girder extends horizontally and is configured as a trussed girder having an upper run having an upper run length, a lower run having a lower run length that is shorter than the upper run length, and two opposite ends;

arranging an adapter on at least one of the two opposite ends of the crane girder and orienting the adapter relative to the upper run and the lower run, the adapter having adapter walls comprising connecting limbs extending diagonally from the upper run to the lower run;

fastening a travelling mechanism to the adapter;

arranging a head plate to lie horizontally on the upper run of the crane girder and welding the head plate to the upper run of the crane girder in a desired position;

orienting and welding a connecting plate to the head plate and to the adapter walls in a desired position;

fastening respective lower end portions of the adapter walls of the adapter to the lower run and fastening respective upper end portions of the adapter walls to the head plate;

welding the adapter in the desired position directly to the upper run and the lower run so that the adapter is oriented relative to the upper run and the lower run at least in one longitudinal direction of the crane girder and with the connecting limbs of the adapter walls terminating in the region of the lower run, wherein the lower run is formed to be shorter than the upper run, the connecting limbs of the adapter walls being oriented and welded to the lower run in the desired position; and positioning a crane trolley having a lifting gear along the crane girder, wherein the crane trolley is movable along the crane girder.

* * * * *